United States Patent [19]

Stuckel

[11] Patent Number: 4,807,377

[45] Date of Patent: Feb. 28, 1989

[54] PHOTOGRAPH DISPLAY DEVICE

[76] Inventor: Robert W. Stuckel, 1385 Howard St., Elk Grove Village, Ill. 60007

[21] Appl. No.: 44,759

[22] Filed: May 1, 1987

[51] Int. Cl.[4] ..... A47G 1/06; G09F 1/12

[52] U.S. Cl. ..... 40/152.1; 40/152

[58] Field of Search ..... 40/152.1, 124, 152, 40/124.1, 160, 124.4, 156, 154, 600, 621

[56] References Cited

U.S. PATENT DOCUMENTS

| | | | |
|---|---|---|---|
| 2,262,548 | 11/1941 | Genser | 40/152.1 |
| 2,506,688 | 5/1950 | Scism | 40/152.1 |
| 2,785,490 | 3/1957 | Fabry | 40/152 |
| 3,456,374 | 7/1969 | Baermann | 40/152 |
| 3,624,939 | 12/1971 | Gossard | 40/152 |
| 3,802,104 | 4/1974 | Wiley | 40/152 |
| 4,343,104 | 8/1982 | Szabo | 40/152 |
| 4,653,207 | 3/1987 | Wisniewski | 40/152 |

*Primary Examiner*—Gene Mancene
*Assistant Examiner*—Michael Lynch
*Attorney, Agent, or Firm*—Douglas B. White

[57] ABSTRACT

There is generally provided an object in the shape of an egg which rests on a contoured platform. The egg portion is separable along a transverse plane there-through and, once separated, photographs or the like are displayed on the exposed planar surfaces. To conceal the photographs, the separate members are closed together and magnetically secured.

3 Claims, 2 Drawing Sheets

PHOTOGRAPH DISPLAY DEVICE

BACKGROUND OF THE INVENTION

The present invention relates generally to photograph display devices and more particularly to ornamental devices capable of selectively concealing or displaying photographs.

Heretofore photograph display devices have been predominantly of the picture frame style or, in the alternative, transparent solid objects enclosing a photograph for display. No device has been developed in the prior art which provides a decorative photograph display which is also adaptable to conceal personal photographs in a tasteful, decorative manner.

SUMMARY OF THE INVENTION

It is accordingly an object of the present invention to provide an improved display device that is adapted to support and display the photographs in a first mode of use but to aesthetically conceal the photographs in a second mode of use. It is a further object of the present invention to provide a device which is quickly and easily convertible from a first display mode to a second concealed mode of use.

In the preferred embodiment of the present invention there is generally provided an object in the shape of an egg which rests on a contoured platform. The egg portion is separable along a transverse plane therethrough and, once separated, photographs or the like are displayed on the exposed planar surfaces. To conceal the photographs, the separate members are closed together and magnetically secured.

Other objects and advantages of the invention will become apparent upon reading the following detailed description and upon reference to the drawings.

While the invention will be described in connection with the preferred embodiment, it will be understood that I do not intend to limit the invention to that embodiment. On the contrary, I intend to cover all alternatives, modifications and equivalents as may be included within the spirit and scope of the invention as defined by the appended claims.

DESCRIPTION OF THE PREFERRED EMBODIMENT

Figure 1:
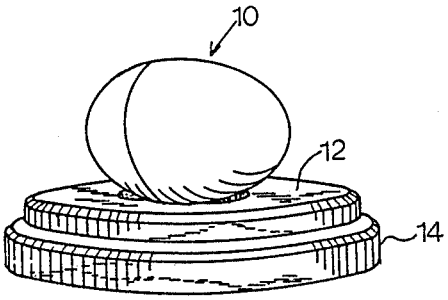
FIG. 1 is a perspective frontal view of the display device of the present invention in its concealed mode of use.
Figure 2:
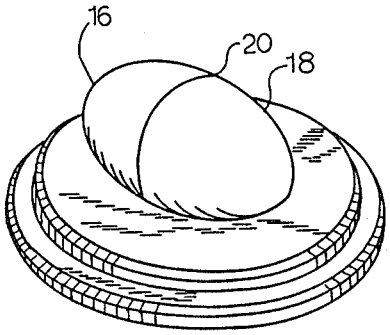
FIG. 2 is a perspective top view of the device of FIG. 1.

Turning to FIG. 1, there is shown in perspective the display portion 10 of the present invention positioned upon a display platform 12 which in turn rests upon a display base 14. This display portion 10 is divided into first and second display members 16 and 18 which are attachable along a transverse plane 20. In the preferred embodiment of the present invention these members are accurately formed such that when positioned together the joint line becomes virtually unoticeable.

Figure 3:
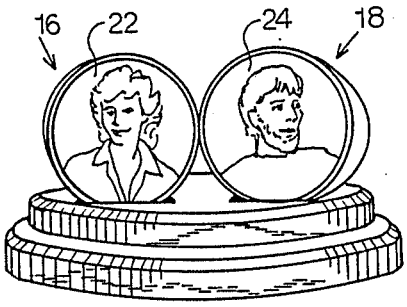
FIG. 3 is a perspective frontal view of the device of the present invention in its display mode of use.
Figure 4:
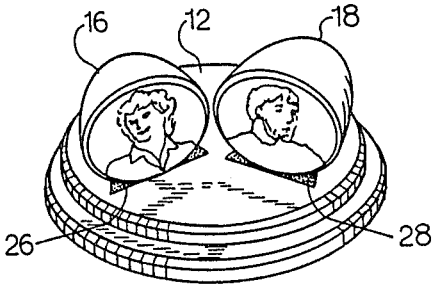
FIG. 4 is a perspective top view of the device of FIG. 3.

In FIG. 3 the device is shown in its display mode wherein photographs 22 and 24 are positioned within respective display members 16 and 18. These members are arranged to sit in display formation upon the display base in molded depressions 26 and 28 as more clearly shown in FIG. 6b.

Figure 5:
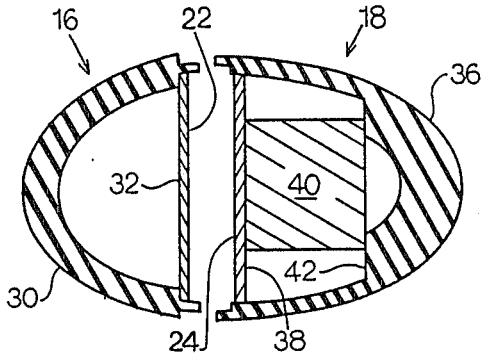
FIG. 5 is a cross-sectional view of the device of the present invention showing the internal structure.

The internal structure of the device is shown in the cross-sectional view of FIG. 5. The first display member 16 is comprised generally of an outer shell portion 30 and a magnetically attractive plate member 32 affixed thereto. A photograph 22 is positioned over the plate member 32 such that it is displayed when the display members are separated but concealed when the display members are joined. The second display member 18 is comprised of an outer shell portion 36 and a non-magnetic plate member 38 affixed thereto. Positioned between the shell and the plate there is provided a magnet 40 affixed to a supporting ring 42 on the shell portion. When the two display members are joined, the magnetic field generated by the magnet 40 pulls on the magnetic plate 32 to secure the display members one to the other. A photograph 24 is positioned against the non-magnetic plate 38 to be revealed when the display members are separated.

Figure 6A:
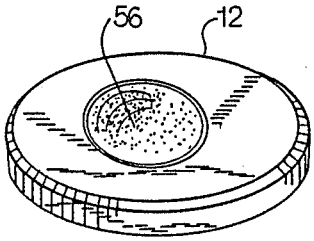
FIG. 6*a* is a perspective view of the display platform of the device for use in the concealed mode.
Figure 6B:
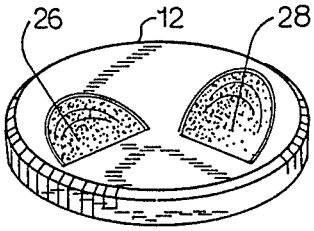
FIG. 6*b* is a perspective view of the reverse side of the display platform of the device for use in the display mode.
Figure 7:
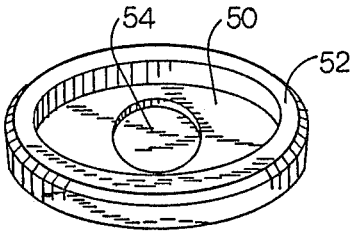
FIG. 7 is a perspective view of the display base of the present invention.

The base member for supporting the display portion is shown in FIG. 7 and represents generally an oblong plate member 50 having a raised edge 52. For user convenience there is located within the center thereof a stencil 54 for use in accurately cutting the photographs or other material to be displayed. This base is arranged to accept within the raised edge the display platform 12. As shown in FIG. 6a and 6b, this platform is contoured to present a depression 56 on one side thereof for supporting the display portion in its closed position and to present dual depressions 26 and 28 on the reverse side thereof for supporting the display device in its opened position.

I claim:

1. A photograph display device comprising:

first and second enclosure members, wherein said enclosure members are arranged to separate entirely one from the other and thereby exhibit first and second cross sectional areas defined on said enclosure members respectively;

planar display means in said enclosure members supporting photographs proximate and parallel to the plane of separation of said enclosure members coincident with said respective cross sectional areas, thereby defining an interior cavity in each of said enclosure members, said planar display means in said first enclosure member comprising non magnetic responsive material, and said planar display means in said second enclosure member comprising magnetically reponsive material; and magnetic means mounted within said interior of said first enclosure members to selectively hold said first and second enclosure members together.

2. The photograph display device of claim 1 wherein said enclosure members join to form an egg-shape.

3. The photograph display device of claim 2 further comprising a supporting platform contoured to present a cradling depression on one side thereof to support the joined egg-shaped device, and to present dual cradling depressions on the reverse side thereof to support the separated portions of the egg-shaped device.

* * * * *